US011149476B2

(12) United States Patent
Miller

(10) Patent No.: US 11,149,476 B2
(45) Date of Patent: Oct. 19, 2021

(54) DOOR STOP

(71) Applicant: Lesley Collette Miller, Noblesville, IN (US)

(72) Inventor: Lesley Collette Miller, Noblesville, IN (US)

(73) Assignee: Lesley Collette Miller, Noblesville, IN (US)

( * ) Notice: Subject to any disclaimer, the term of this patent is extended or adjusted under 35 U.S.C. 154(b) by 0 days.

(21) Appl. No.: 16/821,097

(22) Filed: Mar. 17, 2020

(65) Prior Publication Data

US 2020/0300009 A1 Sep. 24, 2020

Related U.S. Application Data

(60) Provisional application No. 62/821,206, filed on Mar. 20, 2019.

(51) Int. Cl.

| | |
|---|---|
| ***E05F 5/02*** | (2006.01) |
| ***E05C 17/00*** | (2006.01) |
| ***E05C 17/54*** | (2006.01) |

(52) U.S. Cl.

CPC ..... *E05C 17/025* (2013.01); *E05C 17/54* (2013.01)

(58) Field of Classification Search

CPC ..... E05C 17/00; E05C 17/46; E05C 17/54; E05C 17/44; E05C 17/025; E05F 5/02; E05F 5/06; E05F 5/08; E05F 5/18; E05F 5/00; E05Y 2900/132; E05Y 2201/212;

(Continued)

(56) References Cited

U.S. PATENT DOCUMENTS 485,613 A * 11/1892 Deane ..... E05D 11/1007 16/353
5,369,840 A * 12/1994 Salvador ..... E05C 17/54 16/82

(Continued)

FOREIGN PATENT DOCUMENTS

GB 2452146 A * 2/2009 ..... E05F 5/04
WO WO-2016013943 A1 * 1/2016 ..... E05C 17/00

OTHER PUBLICATIONS

"Partial Google Image Search Results from 'Spring Door Closures' Search", Mar. 11, 2020.

(Continued)

*Primary Examiner* — Chuck Y Mah
(74) *Attorney, Agent, or Firm* — Indiano Law Group LLC; E. Victor Indiano; John T. Woods, III

(57) ABSTRACT

A door stop is insertable between a stationery door frame and a movable door for maintaining the door in an open position. The door stop has a body that includes a base portion, a handle portion, an attachment member, and a tether. The base portion is configured for insertion between the door frame and the movable member. The handle portion is coupled to the base portion. The attachment member is configured for being attached to one of a wall, the door frame and door. The tether is provided with a first end that is coupled to the attachment member, and a second end that is coupled to the body. The insertion of the base member between the door frame and door, and the engagement of the base member with the door frame and door maintains the door in an open position.

19 Claims, 6 Drawing Sheets

(58) Field of Classification Search
CPC ..... E05Y 2201/224; Y10S 292/15; Y10S 292/19; Y10S 16/17
See application file for complete search history.

(56) References Cited

U.S. PATENT DOCUMENTS 5,509,235 A * 4/1996 Chander ..... E05C 17/025 160/40
5,511,837 A * 4/1996 Dempsey ..... E05C 17/025 16/319
5,586,793 A * 12/1996 Davenport ..... E05B 17/2026 292/288
6,003,911 A * 12/1999 Sowash ..... E05C 17/025 16/82
6,616,128 B2 * 9/2003 Selzer ..... A62B 3/005 254/104
7,014,229 B1 * 3/2006 Stelmach ..... E05C 17/44 292/342
7,506,905 B1 * 3/2009 George ..... E05C 17/025 16/82
8,458,958 B2 * 6/2013 Cress ..... E05F 5/04 49/462
8,914,945 B2 * 12/2014 Callahan ..... E05F 5/02 16/82
9,127,489 B2 * 9/2015 Orlov ..... E05C 17/025
10,113,350 B2 * 10/2018 Brown ..... E05F 5/06
2007/0126248 A1 * 6/2007 Mintz ..... E05C 17/025 292/342
2008/0079270 A1 * 4/2008 Carlson ..... E05C 17/025 292/343
2008/0277949 A1 * 11/2008 Emde ..... E05C 17/025 292/343
2009/0260182 A1 * 10/2009 Hall ..... E05C 17/025 16/82
2010/0242226 A1 * 9/2010 Hopkins ..... E05C 17/54 16/82
2011/0254293 A1 * 10/2011 Duff ..... E05C 17/025 292/343
2018/0128025 A1 * 5/2018 Estrada ..... E05C 17/56

OTHER PUBLICATIONS

"Partial Google Image Search Results from 'Door Stop' Search", Mar. 11, 2020.

* cited by examiner

DOOR STOP

PRIORITY STATEMENT

The present application is a non-provisional US Patent Application for a DOOR STOP, and claims benefit of priority to Lesley Collette Miller U.S. provisional patent application No. 62/821,206, that was filed on 20 Mar. 2019; all of which are fully incorporated herein by reference.

I. TECHNICAL FIELD OF THE INVENTION

The present invention relates to door stops and, more particularly, to a door stop that is insertable between a door and a door frame for maintaining the door in an open position.

II. BACKGROUND

Most building structures include at least one door assembly that comprises a movable door that is attached by hinges to an immovable door frame. The door pivots about a vertical pivot axis formed by the hinges to move between an open and closed position.

Almost all doors can be maintained easily in a closed position because the engagement of a male lock latch with a female latch plate maintains the door in the closed position. Many doors can also be maintained in an open position without the need of any additional contrivance or appliance so long as no force is exerted on the door to move it to a closed position. Examples of such forces include wind, and closure mechanisms.

Some doors are designed to include a spring actuated closure mechanism whose purpose is to bias the doors to close, unless some countervailing force, such as a door stop, is employed to hold the door in an open position. Spring closures for doors and prior art door stops exist, and by and large, are usually capable of serving their intended function in a workman-like manner. Examples of currently commercially available spring door closures can be seen in Google, "Partial Google image search results from 'Spring Door Closures' Search", 11 Mar. 2020. Examples of existing door stops that are commercially available, can be seen at "Partial Google Image Search Results From 'Door Stop' Search", 11 Mar. 2020.

In most cases, holding a door open while passing through that door does not require the assistance or help from any outside device. An outstretched arm, shoulder, or hip will usually hold a door open long enough to enable a person to pass through it.

However, situations exist where it is very useful to employ a device for holding the door open. One such situation exists when the person who is passing through the door has her hands occupied because she is holding something such as a package or a child. With the increase in online shopping, most persons find themselves in a situation where they need to use both hands to hold a package, while passing through a door. Even before the advent of online shopping, people who carried groceries through a spring-loaded door, or removed furniture through a spring-loaded door were benefitted by employing a device such a door stop to maintain the door in an open position while they passed through.

Another situation where it is helpful to employ a door stopping mechanism to maintain a door in an open position is where the person passing through the door has limited mobility. For those with mobility, balance, or strength limitations, managing a spring door, and especially a spring door with a pneumatic closure can be a dangerous, if not impossible, task.

Persons who are passing through a door while either riding in a wheelchair, or employing a walker usually require both hands to operate the walker or wheelchair. This leaves them with no free hands for holding the door open. In such cases, it would be helpful to have some sort of door stop to hold the door open to facilitate their passage through the door.

Unfortunately, some current door stops, while effective at holding a door open, can be inconvenient to use. For example, a typical "wedge" type door stop that is slid under a door to wedge it in an open position must be moved into position either by sliding it with one's foot or bending over to put in place.

Such bending or foot shoving is often difficult to accomplish by persons whose mobility is sufficiently limited so as to require them to employ a wheelchair or a walker. Additionally, even some fully mobile people may find it difficult or inconvenient to bend over to insert a wedged-shaped door stop in place. Since a door wedge is an independent item, door wedges often get lost or are unavailable when needed. Other door stops may require significant effort to install them, or otherwise require some expense.

In summary, room for improvement exists over current door stops. Therefore, one object of the present invention is to provide a door stop which has improved qualities.

III. SUMMARY OF THE INVENTION

In accordance with the present invention, a door stop is provided that is insertable between a stationery door frame and a movable door for maintaining the door in an open position. The door stop comprises a body that includes a base portion, a handle portion, an attachment member, and a tether. The base portion is configured for insertion between the door frame and the movable member. The handle portion is coupled to the base portion. The attachment member is configured for being attached to one of the door frame and door. The tether is provided with a first end that is coupled to the attachment member and a second end that is coupled to the body. The insertion of the base member between the door frame and door, and the engagement of the base member with the door frame and door maintains the door in an open position.

In a preferred embodiment, the door includes a first hinge side edge and a second lock side edge, and the door frame includes a doorjamb that is placeable against the first hinge side edge of the door when the door is closed. The body of the door stop is sized and configured to engage the hinge side edge and door jamb to maintain the door in an open position.

In another preferred embodiment, the base portion includes a first door engaging portion having a first cross-sectional area, and a second door engaging portion having a second cross-sectional area that is larger than the first cross-sectional area. The first and second door engaging portions can meet at a first transition portion that is configured as an internal corner for engaging at least one of the door frame and door.

Most preferably, the base includes a third door engaging portion disposed adjacent to the second door engaging portion and having a cross-sectional area greater than the second door engaging portion. The second and third door engaging portions meet at an internal corner configured second transition portion that is configured for engaging at least one of the door frame and door.

One feature of the present invention is that it includes an attachment member that is configured for being attached to one of a wall, door frame and door, and a tether having a first end coupled to the attachment member and a second end coupled to the body. This feature has the advantage of enabling the device to be conveniently positioned by the user by making the device attachable to a wall or door at a convenient height for the user.

The attachment member is fixedly, but removably attached to a door or a wall at a convenient height, which may either be relatively higher for a standing person, or lower for a wheelchair bound person. When so positioned, the user can grab it easily to insert it into and remove it from its position between the door and the door frame. Additionally, once removed from the door frame, the base member can hang by the tether from the attachment member in a convenient position where it will remain until being needed again. Through this arrangement, the device will not become lost or misplaced, and will always be a position where the user can easily insert it into and out of position without having to bend over, kick it, or otherwise exert himself unnecessarily.

Another feature of the present invention is that the base portion includes a first door engaging portion having the first cross-sectional area, a second door engaging portion having a second cross-sectional area larger than the first cross-sectional area, and a third door engaging portion disposed adjacent to the second door engaging portion, and having a cross-sectional area greater than the second door engaging portion.

This configuration creates two transition areas with the first being between the first door-engaging portion and the second door-engaging portions; and the second transition portion being between the second and third door-engaging portions. The first and second transition portions are the primary areas upon the device that engage the door and frame corners, as both of the transition areas are preferably shaped as internal corners. As the cross-sectional area of the first and second door engaging portions are different, the device has the advantage of having increased adaptability, as it can better accommodate a variety of different door configurations that have different spacing between a corner of a doorjamb and a corner of a door.

Additionally, as the device is shaped rectangularly, the device can be inserted into its engaged position in either a vertical or horizontal orientation. In a vertical orientation, the width of the device is relatively smaller, when compared to the width of the device when placed in the horizontal orientation. As such, as the device can be used in both a vertical and horizontal orientation, the device has additional adaptability to accommodate door situations wherein even a wider gap exists between corners of a door and a door frame.

One feature of the present invention is that it is held in place in a doorjamb through the force caused by the exertion of a closing pressure by a door's self-closure mechanism.

The release of the pressure allows the door stop to become disengaged from the door jamb and, under the influence of gravity, return to its storage position away from the door jamb, which allows the door to close. For the user, the release of this pressure is easily accomplished by using a hip, shoulder or hand to move the door to a relatively more-opened position for a short period long enough to allow the door stop to fall out of the door jamb engagement and return to its storage position. There is no need for the user to manually manipulate or touch the door stop, or perform any mobility intensive movements such as bending over to move the door stop, or kicking the door stop out of the way. Further, as the attachment member couples the door stop to a convenient storage position, the user does not have to spend any time or effort to return the door stop to its proper storage location.

These and other features of the present invention will become apparent to those skilled in the art upon a review of the drawings and description below, which represent the best mode of practicing the invention perceived presently by the applicant.

IV. BRIEF DESCRIPTION OF THE DRAWINGS

V. DETAILED DESCRIPTION OF INVENTION

Figure 1:
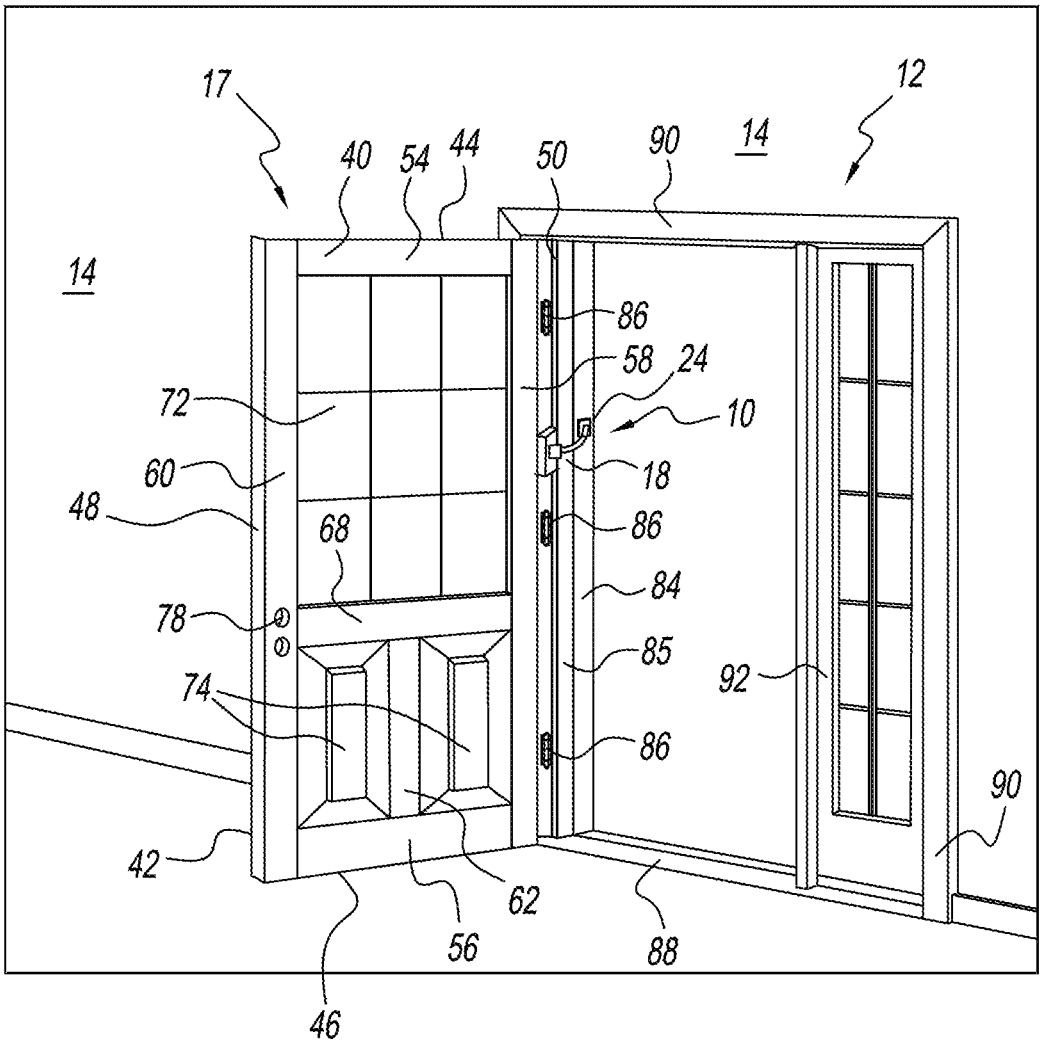
FIG. 1 is a perspective view of a typical door, showing the device inserted therein.
Figure 2:
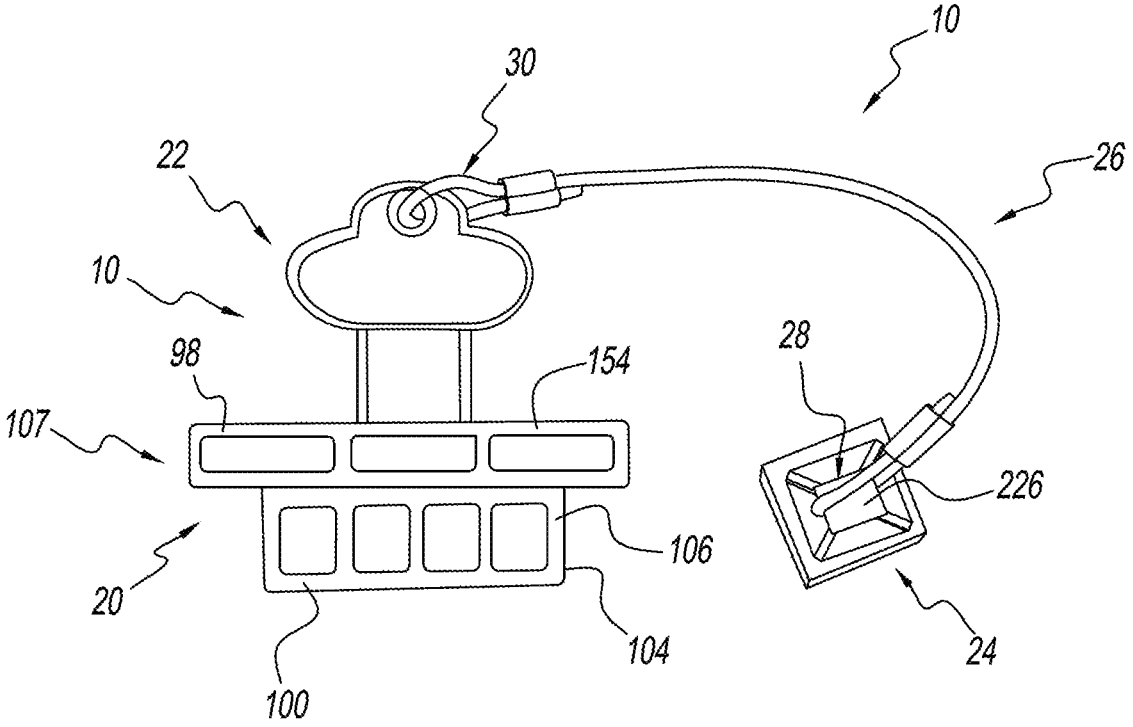
FIG. 2 is a side view of the device.

The figures show a door stop 10 that is insertable between a stationery door frame 12 and a movable door 17. The door frame 12 is fixedly coupled to a stationery structure such as a wall 16. The door stop 10 has a body 18 that includes a relatively enlarged base portion 20, and a relatively axially extending handle portion 22 that extends upwardly and axially outwardly from the base portion 20. Attachment member 24 is provided for attaching the body 18 to one of the walls 16, door 17, and door frame 12. A tether 26 is provided that includes a first looped end 28 and a second looped end 30. The first looped end 28 is coupled to the attachment member 24, and the second looped end 30 is coupled to the body 18.

The device 10 is configured such that the insertion of the base member 20, between the door frame 12 and door 17, along with the engagement of the base member 20 with the door frame 12 and door 17 maintains the door 17 in an open position, as shown in FIG. 1.

The door 17 is maintained in its closed position through the engagement of a male latch member (not shown) of the door that is inserted into a cavity or aperture in a lock plate (not shown) that is attached to and drilled into a doorjamb portion of the door frame.

To establish a context of use of the door stop 10, the reader's attention is now directed to FIG. 1 which shows the various components of the door assembly including a door frame 12, door 17, and wall 16 with which the door stop 10 of the present invention is used.

The door includes first major surface 40 that here is shown as the door's outside surface 40 and door frame 16 that are designed primarily to be an exterior door of the type that one might see on a residence. In most cases, the outside surface 40 of the door 17 will be treated with a weatherproof treating to help protect the surface of the door from the elements.

The opposite major surface is the interior surface 42. The door 17 also includes a plurality of edged surfaces, such as the top edge surface 44, the bottom edge surface 46, the lock side edge 48, and the hinge side edge 50. The lock side edge 48 is configured so as to receive a tubular lock assembly (not shown) within the tubular bore 78. Examples of suitable lock mechanism can be shown in websites operated by companies such as Schlage, Kwikset, Oak Security, Best Lock, and others.

The exterior door shown in FIG. 1 also includes several primary structural members that provide the bulk of the structural strength of the door. These include a horizontally disposed top rail 54 that extends along the top of the door, a horizontally extending bottom rail 56 that extends along the bottom of the door, and a lock rail 68 that extends horizontally at about the same position as the tubular lock double bores 78.

In addition to the laterally extending rails, there are also vertically extending rails that provide structural support for the door. These include vertically extending hinge stile 58 that extends vertically along the door adjacent to the hinge side edge 50; and a lock stile 60 that extends vertically from the top to the bottom of the door adjacent to the lock side edge 48. A mullion 62 is a structural support member that extends between the bottom rail 56 and the lock rail 68, and is disposed halfway between the hinge style 58 and the lock style 60.

A glass panel 72 is disposed between the hinge stile 58 and lock stile 60, and between the top rail 54 and lock rail 68. The glass panel is shown as comprising a plurality of individual panels that are joined together by a framework. A glass panel 72 may be translucent, or even opaque. A pair of opaque wooden panels 74 are disposed in the door between the bottom rail 56 and the lock rail 68. The mullion 62 divides one of the panels 74 from another panel.

The door frame 80 is stationarily mounted to the wall 14 in a conventional manner. The door frame includes vertical extending door jambs 84 which include interior facing surfaces for being placed in an opposed relationship to the hinge side edge 50 and the lock side edge 48 of the door 17. The doorjamb 84 may include a raised stop portion 85.

One or more hinges 86 are fixedly coupled to the doorjamb 84 and the hinged side edge 50 of the door 17 to enable the door 17 to pivot with respect to the door frame 12 about the vertical axes of the hinges 86.

In FIG. 1, the door is shown as having three spaced hinges 86 including a top hinge, middle hinge, and bottom hinge 86. However, it will be appreciated that other hinge arrangements (such as two hinges) or more hinges may be employed. In some circumstances, one may even desire to use what is known as a "piano hinge" (not shown) which is a long-extended hinge that is sufficiently long enough so as to provide support for the entire door through the use of one hinge.

When the door is closed, the hinge side edge 50 and doorjamb 84 are positioned so that the doorjamb 84 and hinge side edge 50 are disposed next to each other in a parallel plane relationship.

The distance between, and configuration of the hinge side edge 50 and doorjamb 86 that is disposed adjacent to the hinge side edge 50 are those parts of the door that have the greatest impact upon the operation of the door stop 10 of the present invention. As such, the remainder of the components of the door 17 and door frame 12 can be similar to those shown, or very different than those shown in FIG. 1, without impacting the operation of the door stop 10 significantly. However, the configuration and relative positioning of the hinge side edge 50 and the doorjamb 84 do impact the operation of the door stop. For example, the space between the hinge side edge 50 and doorjamb 84 will vary depending upon the degree to which the door 17 is open. This variance should be accommodated by the door stop 10.

As will be discussed in more detail below, the door stop of the present invention is designed to accommodate such variances.

It will also be noted from FIG. 1, that the door 17 is capable of being opened anywhere between about 1 degree and 180 degrees, relative to the wall 14 and major plane of the door frame 12. This ability to open 180 degrees however, is often limited by either the door configuration, the engagement of a lock handle with a wall, or the positioning of a wall at an angle to the door frame that is less than 180 degrees. For example, in many cases, a door 17 may be positioned on a wall at a position close to an intersecting wall.

In that case, the ability of the door 17 to open may be limited to possibly only 90 to 100 degrees. In other situations, the spring closing mechanism of the door will limit its movement so that at its maximum opening position, the door 17 is only somewhere between possibly 70 and about 110 degrees from the plane of the wall 60 and the major plane of the door frame 12.

In the most preferred embodiment, the door stop 10 of the present invention allows the door to remain open at somewhere between about 60 and 180 degrees from the plane of the wall. This 60-degree opening usually represents a degree of opening that is great enough to allow someone to pass through the door who is either carrying a package, a person, or else is using a walker or a wheelchair. A 180-degree opening, when possible, is useful because it tends to get the door out of the door way as far as possible.

With most doors, the ability to maintain the door at an opening angle of between 90 to 120 degrees serves well for most purposes.

Returning back to FIG. 1, the threshold 80 comprises the bottom rail of the door fame that extends between the floor and the bottom edge 46 of the door. The casing 90 comprises the decorative trim that surrounds the door frame. Normally, when a door is installed, the drywall and/or frame members of the wall are laid open so that the door frame may be inserted in the hole or aperture cut in the wall to receive the door frame 12 and door 17.

When the door is installed, there is usually a gap between the side edge of the door 17 and the edge of the adjacent drywall. The casing 90 helps to cover this gap and provide a good aesthetic appearance.

The door assembly shown in FIG. 1 also includes a window containing side light 92 which is an optional feature.

As discussed above, the door 17 shown in FIG. 1 is exemplary, and the present invention will work with a wide variety of doors of different sizes, shapes, and configurations.

As best shown in FIGS. 2-5A, the base portion 20 of the body 18 includes a planar distal surface 98 and a planar proximal surface 100. It should be noted that the terms "proximal" and "distal" are relative terms provided not as limitations, but rather to provide a source of reference. As used herein, the direction proximal is used to indicate that direction or portion of the base unit that is closer to the proximal end surface 100 of the device 10. In contrast, the term "distal" is used to denote that potion of the device 10 which is relatively closer to the handle portion 22 of the device 10.

The base portion 20 includes a generally proximally disposed first door engaging portion 104 that is generally rectangular in cross-section. A second door engaging portion 106 is disposed relatively distally and adjacent to the first door engaging portion 104. The second door engaging portion 106 also has a rectangular cross-section, and has a second cross-sectional area that is greater than the first cross-sectional area of the first door engaging portion 104.

A third door engaging portion 107 is disposed distally of the second door engaging portion 106, and is disposed adjacent thereto. The third door engaging portion 107 is generally rectangular in cross-section and has a third cross-sectional area that is greater than the second cross-sectional area of the second door engaging portion 106.

The body 18 of the door stop 10 is preferably unitarily formed and designed so that the device can be made within a single cavity of an injection mold, so that there is no assembly required to the body 18. Because of this, the first 104, second 106, and third 107 door engaging portions are all unitarily formed with each other and are all coupled with each other. Although in theory they could be made as separate elements, there is no reason to do so as it is much less expensive to make them unitarily.

The first door engaging portion 104 includes a first side surface 108, and a second side surface 110, which are generally identical, but mirror images of each other. The first and second side surfaces 108, 110 are disposed on opposite sides of the body 18.

The first door engaging portion 104 also includes multi-segmented first 112 and second 114 end surfaces.

The second door engaging portion 106 also includes a multi-segmented first side surface 120, and a multi-segmented second side surface 122.

The first and second multi-segmented side surfaces 120, 122 are generally identical, but mirror images of each other, and are disposed on opposed sides of the body 18. The first and second side surfaces 120, 122 are generally disposed in a plane parallel to the plane of the multi-segmented first and side surfaces 108, 110 of the first door engaging portion 104.

The second door engaging portion 106 also includes a first end surface 124 and a second end surface 126.

The first and second end surfaces 124, 126 of the second door engaging portion 106 are generally co-planar with the first and second end surfaces 112, 114 of the first door engaging portion 104.

The second door engaging portion 106 also includes first 128 and second 129 proximally-facing surfaces. The intersection of the first proximally-facing surface 128 of the second door engaging portion 106, with the first side surface 108 of the first door engaging portion 106 forms an internal corner shaped first transition portion 132.

Similarly, the intersection of the second proximally-facing surface 129 of the second body portion 106 with the second side surface 110 of the first door engaging portion 104 forms another first transition portion 134 that is shaped as an internal corner. The internal corner shape of the transition portions 132, 134 is designed for snuggly receiving corners of the respective door 17 and doorjamb 84.

With regard to the door 17, the corner received by the first transition portion 132 is usually the corner that is defined by the hinge side edge 50 and interior side major surface 42 of the door 17.

Similarly, the first transition portion 134 of the second side of the base portion is designed for receiving a corner defined by the doorjamb 84 and an interior casing member 148 that is disposed adjacent to the doorjamb 84.

Figure 3:
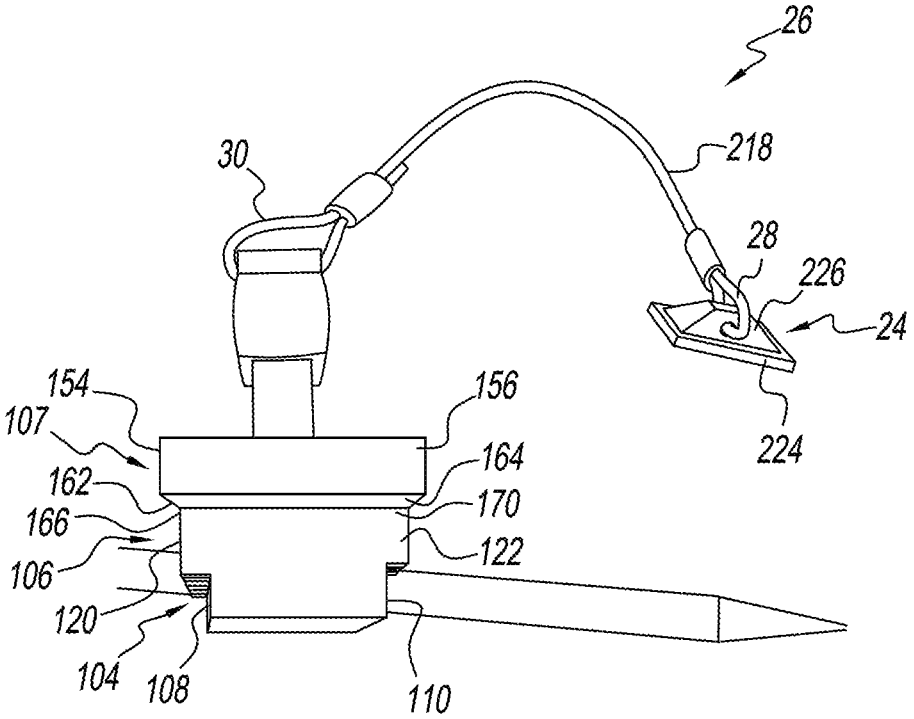
FIG. 3 is an end view of the device.
Figure 3A:
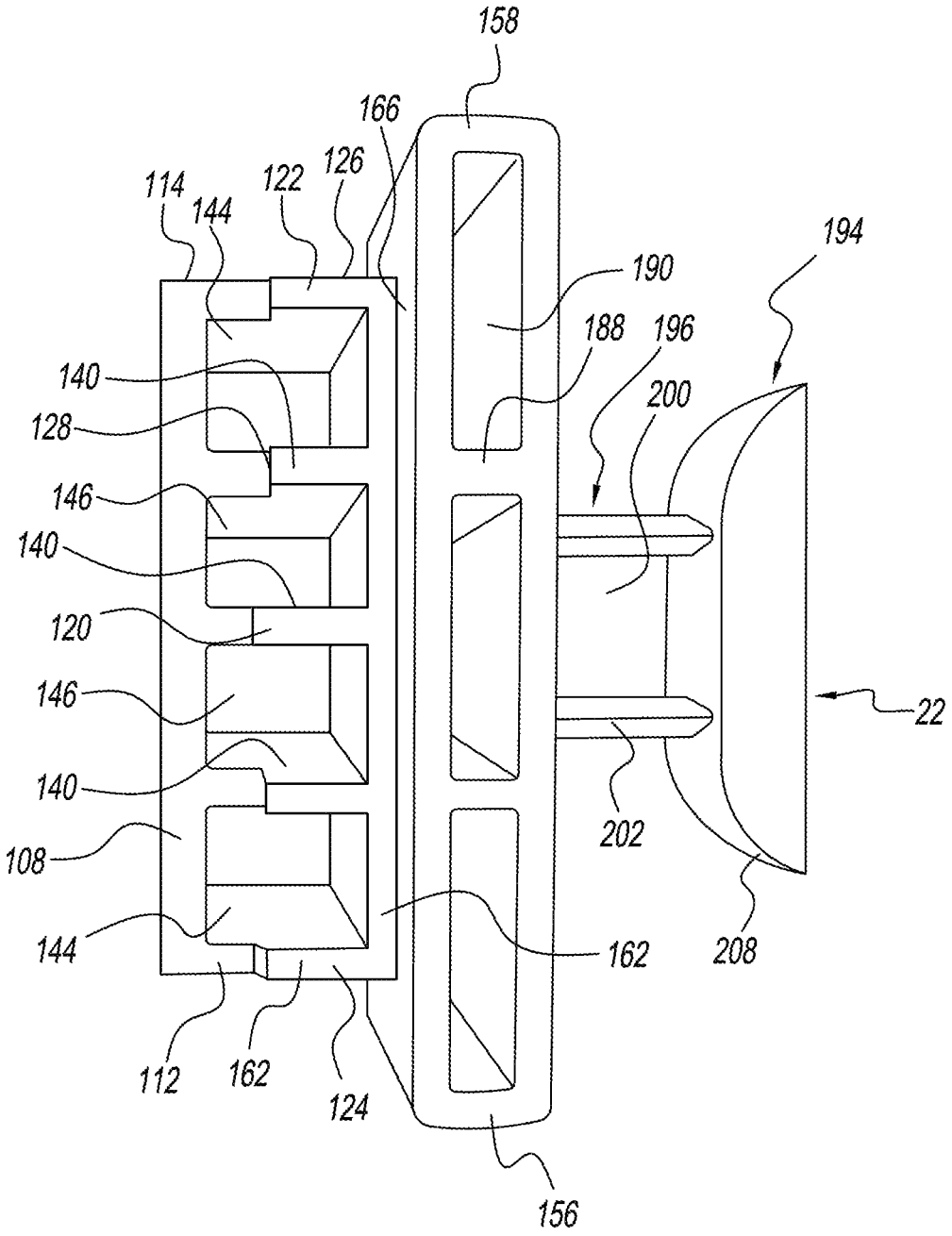
FIG. 3A is an enlarged side view of the device.
Figure 4:
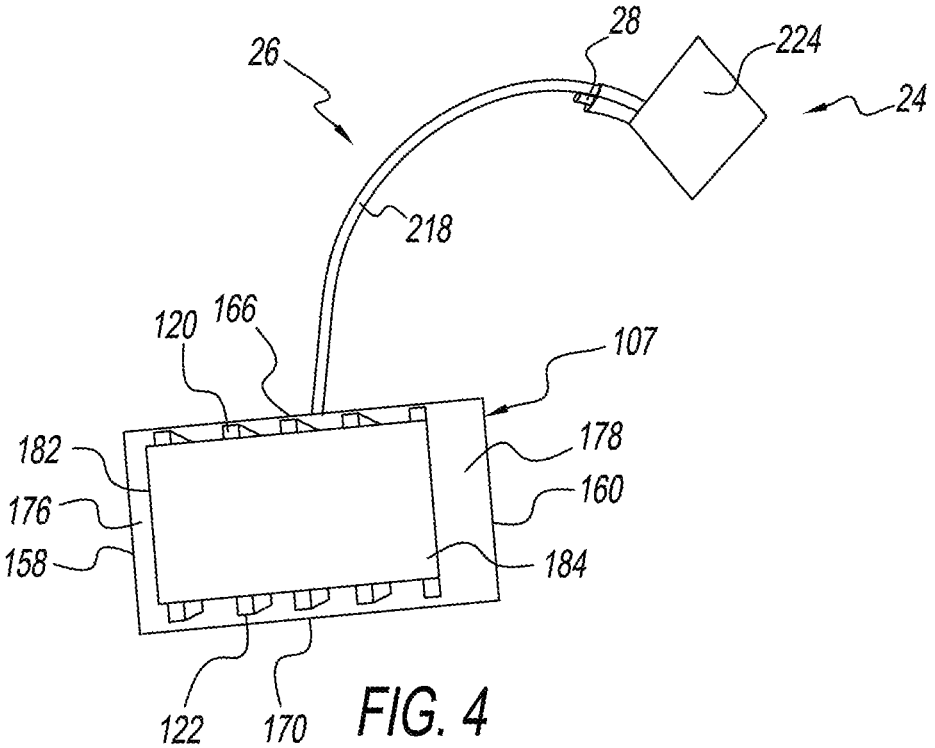
FIG. 4 is a bottom view of the device.
Figure 5:
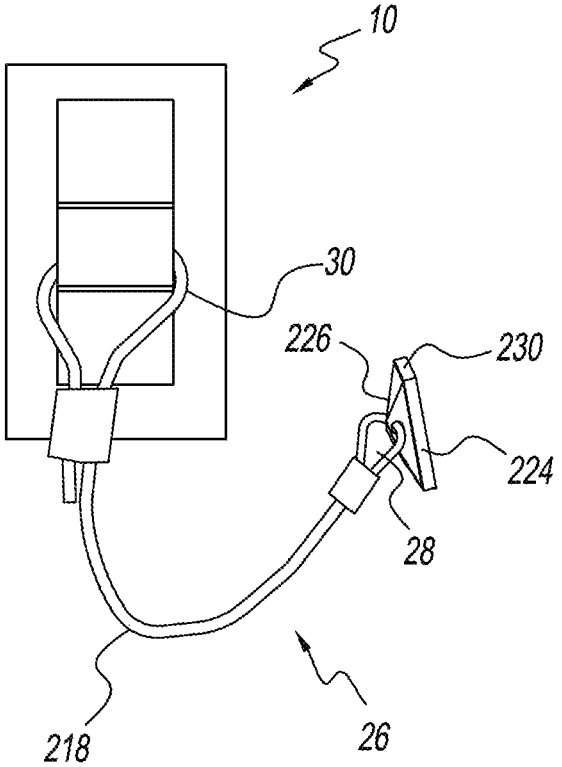
FIG. 5 is a top view of the device.
Figure 5A:
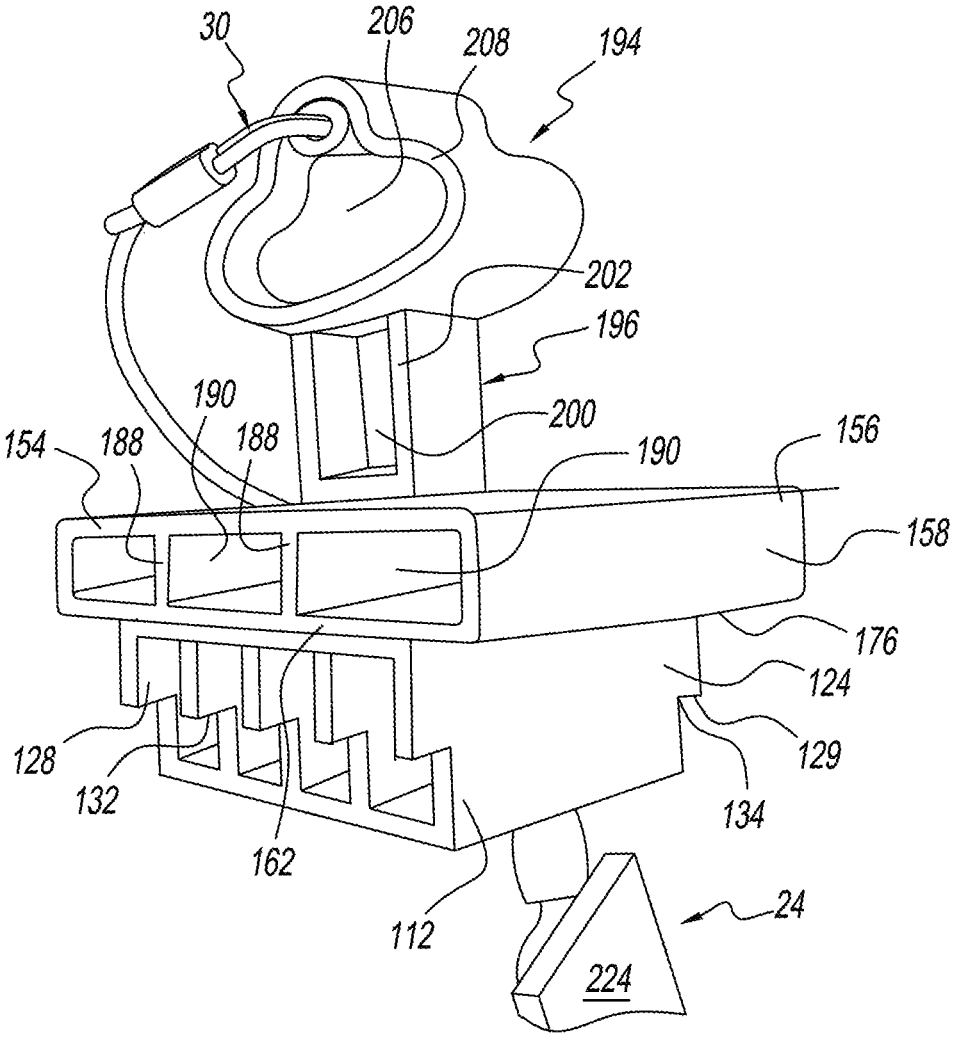
FIG. 5A is a perspective view of the device.

As is best shown in FIG. 3A, the first and second door engaging portions 104, 106 are formed through five wall members 140 that define four channels therebetween, including outboard channels 144, and inboard channels 146. In the most preferred embodiment, the outboard channels 144 are blind channels that include a supporting wall disposed midway between the first and second sides. In contract, the internal channels are "full through" channels that extend to provide an open channel between the first and second sides.

The primary reason to use the channel construction relates to weight-saving and material cost. By using the channel system, the five upstanding walls 140 can provide sufficient structural rigidity, while reducing the amount of plastic required to make the stop 10. It will be appreciated that if the first and second door engaging portions 104, 106 were made to be solid, a substantial additional amount of plastic would be required for the device 10, which thereby would increase both the weight and the cost of producing the product.

The third door engaging portion 107 includes a first side surface 154 and a second side surface 156 that are disposed adjacent to the first and second side surfaces, respectively, of the first 104 and second 106 door engaging portions. The third door engaging portion also includes a first end surface 158 and a second end surface 160.

Unlike the end surfaces 124, 126 of the second base portion 106, the end surfaces 156, 158 of the third door engaging portion 107 lie in a parallel plane with the first 112, 122 and second 114, 126 edges of the respective first 104 and second 106 door engaging portions.

The third door engaging portion 107 also includes first and second side proximally-facing surfaces, that are generally disposed in a parallel plane with the first and second 128, 129 proximally-facing surfaces of the second door engaging portion 106. The first and second proximally-facing surfaces 162, 164 form transition portions 166, 170 where the proximally-facing side surfaces 162, 164 intersect with the first and second side surfaces 154, 156. The transition portions 166, 168 are generally configured to be internal corners for receiving a corner of the door 17 and door frame 12.

As the third door engaging portion 107 has a cross-sectional area greater than the cross-sectional area of the second door engaging portion 106, the transition portions 166, 170 between the second and third door engaging portions have generally a greater width than the transition portions 132, 134 between the first 104 and second 106 door engaging portions.

In addition to the door engaging surface that is formed on the sides of the device 10 adjacent to the third door engaging portion 107, there also exists a third transition portion 182, 184 that exists on the ends of the device 10, rather than the sides. The third transition portions 182, 184 are formed at the intersection of the first and proximally-facing surface 176 and the first end surface 158; and also at the intersection of the second end proximally-facing surface 178 and the second end surface 160.

As best shown in FIG. 3A, the third door engaging portion 107 is formed similarly to the first and second door engaging portions 104, 106 in that it includes a series of upstanding walls 188 which define three channels 190 therebetween. The central channel is designed to be a through channel 190 which extends all the way through the device, whereas the outboard channels 190 are designed to include an upstanding separating and supporting wall portion therebetween. The purpose of the channels 190 is to reduce the amount of plastic and weight of the body 18, and the purpose of the upstanding walls 188 is to provide additional strength and structural rigidity to the body 18.

The handle 22 includes a head portion 194 and a neck portion 196. The neck portion 196 includes a generally planar central portion 200 having a pair of generally perpendicular side flanges 202 on either side of the central portion 200. Through this configuration, the neck 196 has a generally I-beam shaped configuration, to provide structural rigidity and resistance to bending.

The head portion 194 includes a generally planar central portion 206 that is surrounded by a perimetral flange 208 that is disposed in a plane generally perpendicular to the plane of the central portion 206. The central portion 206 is preferably designed to have a large enough surface so as to enable an embossed, engraved, or printed message to be placed thereon.

This ability to have a message placed thereon helps to increase the marketability of the device 10, as it provides a place on which the name of a purchaser (e.g., a hospital or rehabilitation facility, or shipping company) could print their name and logo and thereby employ the door stop 10 as a promotional product to promote their businesses.

The tether 26 includes the first looped end 28 and the second looped end 30. A closure clip is provided for coupling two portions of the rope-like middle portion 218 of the tether together so as to form a permanent loop at the first looped end 28 and second looped end 30.

The length of the tether 26 can be varied depending upon the use and desire of the manufacturer. However, it has been found that a thin rope-like middle portion 218 member that results in a tether 16 somewhere between about five and ten inches that works well with the most preferred embodiment of the present invention.

The first looped end 28 of the tether 26 is fixedly coupled to an aperture that is formed in the attachment member 24. The second end 30 is attached to, and extends through, an aperture that is formed in the head portion 194 of the handle portion 22 of the device 10.

The attachment member 24 includes a body member 230 that is preferably about less than one-inch square, and is formed from a plastic. The bottom surface 224 of the attachment member 224 preferably contains some sort of adhesive member to enable the bottom surface 224 to be adhesively attached to a wall, door frame or door so that the device 10 always remains close to the site at which it is used, and thereby is less likely to be lost. The particular adhesive can comprise one of a variety of adhesives such as double-stick tape, hook-and-eye fasteners, methyl methacrylate glues, or possibly even a nail that would be driven through the body to 30 of the attachment member 24.

An aperture containing upraised tether receiver 226 is formed on the upper surface of the attachment member 24. The tether receiver 226 includes an aperture for receiving the loop 28 of the first looped end 28 of the tether 26.

Figure 7:
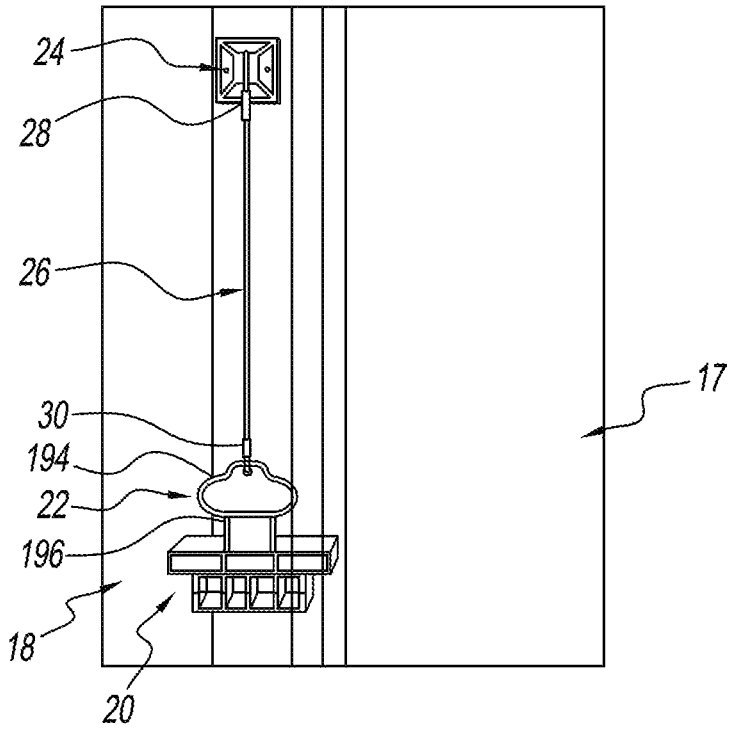
FIG. 7 is a door view of the device in its storage position, not engaged with the door.

Turning now to FIG. 7, the attachment member 24 is shown as being coupled to a casing of a door frame, wherein the body portion 18 of the device is in a storage position. The body portion 18 is coupled by the tether 26 to the attachment member 24, and can, under the influence of gravity hang down therefrom.

Figure 6:
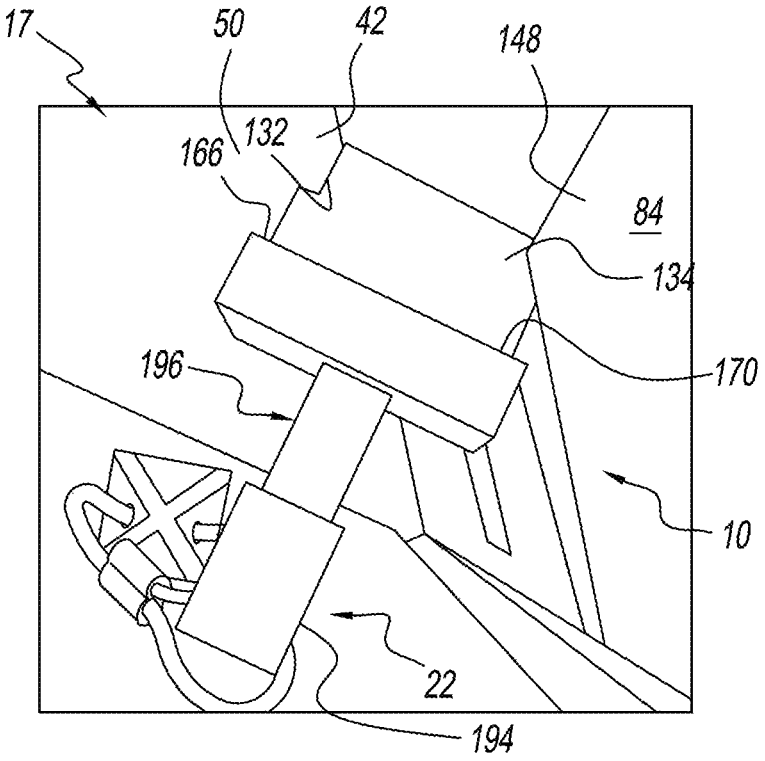
FIG. 6 is a top view of the device inserted between a doorjamb and a door to maintain the door in an open position.

FIG. 6 shows the device 10 in the engaged or use position. In FIG. 6, it will be noted that the first transition portion 132 is engaging a corner of the door 17, and the second door engaging transition portion 134 is engaging the corner of the doorjamb 84. When in this position, the relative closing motion of the door 17 is prevented, thus maintaining the door 17 in an open position.

As shown in FIG. 7, the device can be positioned so that it is disposed at a height that is convenient for the user to engage the body 18 without bending over. The user can then easily position the body 18 into the door engaging position such as shown in FIG. 6, until the device 10 is no longer necessary. At this point, since the body 18 is engaged in a convenient position, the user can then grab the handle 22 to remove the body 20 from its engagement with the door 17 and door frame 12, allow the body 118 to drop into its storage position under the weight of gravity, and allow the door 17 to then close in the door frame 12.

As the door stop 10 is held in place in a doorjamb through the force caused by the exertion of a closing pressure by a door's self-closure mechanism, (FIG. 6) the release of the pressure allows the door stop 10 to become disengaged from the doorjamb and, under the influence of gravity, return to its storage position (FIG. 7) away from the doorjamb, which allows the door to close. For the user, the release of this pressure is easily accomplished by using a hip, shoulder or hand to move the door 17 to a relatively more-opened position for a short period long enough to allow the door stop 10 to fall out of the doorjamb engagement and return to its storage position. There is no need for the user to manually manipulate or touch the door stop 10, or perform any mobility intensive movements such as bending over to move the door stop 10, or kicking the door stop 10 out of the way. Further, as the attachment member 24 couples the door stop to a convenient storage position, the user does not have to spend any time or effort to return the door stop 10 to its proper storage location.

Having described the invention with respect to certain preferred embodiments, it will be appreciated that modifications and variations exist within the scope and spirit of the appended claims.

What is claimed is:

1. A door stop insertable between a stationery door frame and a movable door for maintaining the door in an open position, the door stop comprising a body including:

a base member configured for insertion between the door frame and the movable door;

a handle portion coupled to the base member;

an attachment member configured for being attached to one of a wall, the door frame and door at an elevated position above the floor; and a tether having a first end coupled to the attachment member and a second end coupled to the body;

wherein the insertion of the base member between the door frame and door, and the engagement of the base member with the door frame and door maintains the door in an open position, and wherein the tether and attachment member are configured so that the removal of the base member from between the door frame and door causes the base member to position itself on the wall, door, or door frame to which it is attached below the attachment member while being connected to attachment member by the tether, in a position that does not impede the normal operation of the door.

2. The door stop of claim 1 wherein the door includes a first hinge side edge and a second lock side edge, and the door frame includes a door jamb member placeable against the first hinge side edge when the door is closed, wherein the body of the door stop is sized and configured to engage the hinge side edge and the door jamb to maintain the door in an open position.

3. The door stop of claim 2 wherein the door jamb includes a corner portion and the hinge side edge includes a corner portion, the door stop body being sized to extend between and engage the corner portion of the door jamb and the corner portion of the first side edge to maintain the door in an open position.

4. The door stop of claim 3 wherein the door stop is sized to maintain the door in an open position that is in a plane of between about 60° and 180° from a plane of a wall in which the door frame is installed.

5. The door stop of claim 1 wherein the base member includes a first door engaging portion having a first cross-sectional area and a second door engaging portion having a second cross sectional area larger than the first cross-sectional area.

6. The door stop of claim 5 wherein the first and second door engaging portions meet at a first transition portion configured for engaging at least one of the door frame and door.

7. The door stop of claim 6 wherein the first transition portion comprises a corner shaped intersection of the first and second door engaging portions.

8. The door stop of claim 7 wherein the corner shaped intersection is formed at the intersection of the first door engaging portion that is disposed in a first plane, and a second door engaging portion that is disposed in a second plane perpendicular to the first plane.

9. The door stop of claim 1 wherein the handle portion extends axially outwardly from the base member and includes an aperture for receiving the tether.

10. The door stop of claim 1 wherein the base member includes at least one laterally extending hollow channel.

11. The door stop of claim 10 wherein the base member includes a first door engaging portion and a second door engaging portion, at least one the first and second door engaging portions includes the laterally extending hollow channel.

12. The door stop of claim 11 wherein the laterally extending hollow channel is common to the first and second door engaging portions.

13. The door stop of claim 1 wherein the base member includes at least one laterally extending hollow channel.

14. The door stop of claim 1 wherein the door stop is configured to be moveable between an engaged position wherein it engages the door frame and the door, under pressure to hold the door in an open position, and a disengaged position wherein the door stop is disengaged from the door frame and door to allow the door to close, wherein a further opening of the door to release the pressure on the door stop causes the door stop to move into the disengaged position without further human intervention, to allow the door to close.

15. A door stop insertable between a stationery door frame and a movable door for maintaining the door in an open position, the door stop comprising a body including:

a base member configured for insertion between the door frame and the movable door; the base member including a first door engaging portion having a first cross-sectional area and a second door engaging portion having a second cross sectional area larger than the first cross-sectional area, the first and second door engaging portions meet at a first transition portion configured for engaging at least one of the door frame and door, the first transition portion comprises a corner shaped intersection of the first and second door engaging portion portions, wherein the corner shaped intersection is formed at the intersection of the first door engaging portion that is disposed in a first plane, and the second door engaging portion that is disposed in a second plane perpendicular to a handle portion coupled to the base member;

an attachment member configured for being attached to one of a wall, the door frame and door; and a tether having a first end coupled to the attachment member and a second end coupled to the body;

wherein the insertion of the base member between the door frame and door, and the engagement of the base member with the door frame and door maintains the door in an open position and wherein the base member includes a third door engaging portion disposed adjacent the second door engaging portion and having a cross-sectional area greater than a cross sectional area of the second door engaging portion.

16. The door stop portion of claim 15 wherein the second and third door engaging portions meet at a second transition portion configured for engaging at least one of the door frame and door.

17. The door stop of claim 16 wherein the second transition portion comprises an interior corner shaped intersection of the second and third door engaging portions.

18. A door stop insertable between a stationery door frame and a movable door for maintaining the door in an open position, the door stop comprising a body including:

a base member configured for insertion between the door frame and the movable door;

the base member including at least one laterally extending hollow channel, a handle portion coupled to the base portion; a first door engaging portion and a second door engaging portion, at least one the first and second door engaging portions including the laterally extending hollow channel, and wherein the laterally extending hollow channel is common to the first and second door engaging portions an attachment member configured for being attached to one of a wall, the door frame and door; and a tether having a first end coupled to the attachment member and a second end coupled to the body;

wherein the insertion of the base member between the door frame and door, and the engagement of the base member with the door frame and door maintains the door in an open position and wherein the base member includes a third door engaging portion having a hollow channel and a cross-sectional area greater than a cross-sectional area of the second door engaging portion, the second door engaging portion cross-sectional area being greater than the cross-sectional area of the first door engaging portion.

19. A door stop insertable between a stationery door frame and a movable door for maintaining the door in an open position, the door stop comprising a body including:

a base portion configured for insertion between the door frame and the movable door, the base portion including a first door engaging portion having a first cross-sectional area and a second door engaging portion having a second cross-sectional area larger than the first cross-sectional area, the first and second door engaging portions meeting at an internal corner shaped transition portion, the base portion including a third door engaging portion disposed next to the second door engaging portion and having a third cross-sectional area greater than the second cross-sectional area, wherein the second and third door engaging portions meet at an internal corner shaped second transition portion configured for engaging an external corner of at least one of the door frame and door, and an attachment member coupled to the body and including an attaching portion for attaching the attachment member to one of a wall, the door frame, and the door.

* * * * *